US009302830B2

(12) United States Patent
Ramsey et al.

(10) Patent No.: US 9,302,830 B2
(45) Date of Patent: Apr. 5, 2016

(54) STRUCTURES AND METHODS FOR CONTROLLING FRAGRANCE RELEASE USING ENCAPSULATED FRAGRANCE ON CONTAINER BODIES

(71) Applicant: Crown Packaging Technology, Inc., Alsip, IL (US)

(72) Inventors: Christopher Paul Ramsey, Wantage (GB); Peter Alan Young, Wantage (GB); Daniel A. Abramowicz, Richboro, PA (US)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/861,936

(22) Filed: Apr. 12, 2013

(65) Prior Publication Data

US 2013/0270267 A1 Oct. 17, 2013

Related U.S. Application Data

(60) Provisional application No. 61/636,916, filed on Apr. 23, 2012, provisional application No. 61/624,015, filed on Apr. 13, 2012.

(51) Int. Cl.

| | |
|---|---|
| ***B65D 51/24*** | (2006.01) |
| ***B65D 17/00*** | (2006.01) |
| ***B65D 17/50*** | (2006.01) |

(52) U.S. Cl.

CPC ..... *B65D 51/24* (2013.01); *B65D 17/163* (2013.01); *B65D 17/165* (2013.01); *B65D 17/502* (2013.01); *B65D 2203/12* (2013.01); *B65D 2517/0056* (2013.01)

(58) Field of Classification Search

CPC .... B65D 51/24; B65D 17/163; B65D 17/502; B65D 17/165

USPC ..... 220/212, 269; 215/228; 222/402.1

See application file for complete search history.

(56) References Cited

U.S. PATENT DOCUMENTS

| | | | | |
|---|---|---|---|---|
| 4,717,710 | A * | 1/1988 | Shimizu et al. | 503/213 |
| 5,129,541 | A | 7/1992 | Voigt et al. | |
| 5,542,557 | A | 8/1996 | Koyama et al. | |
| 6,098,830 | A | 8/2000 | Jamieson | |
| 6,102,224 | A | 8/2000 | Sun et al. | |
| 6,653,277 | B1 | 11/2003 | Golz-Berner et al. | |
| 2011/0100854 | A1 * | 5/2011 | Chapin | 206/459.5 |
| 2012/0205386 | A1 * | 8/2012 | Owen et al. | 220/626 |

FOREIGN PATENT DOCUMENTS

WO WO 2010/128149 A1 11/2010

OTHER PUBLICATIONS

Odom et al., "Visual indication of Mechanism Damage Using Core-Shell Microcapsules", ACS Applied Materials & Interfaces, 2011, 3, 4547-4551.*

Odom et al., "Visual indication of Mechanical Damage Using Core-Shell Microcapsules", ACS Applied Materials & Interfaces, 2011, 3, 4547-4551.

* cited by examiner

*Primary Examiner* — Fenn Mathew
*Assistant Examiner* — Elizabeth Volz
(74) *Attorney, Agent, or Firm* — Baker & Hostetler LLP

(57) ABSTRACT

A container or part of a container may comprise fragrance encapsulated in microcapsules configured to release fragrance emitting substance at at least one predetermined period of time.

24 Claims, 14 Drawing Sheets

STRUCTURES AND METHODS FOR CONTROLLING FRAGRANCE RELEASE USING ENCAPSULATED FRAGRANCE ON CONTAINER BODIES

CROSS REFERENCE TO RELATED APPLICATIONS

This application claims priority to U.S. Provisional Application No. 61/636,916, filed Apr. 23, 2012, the contents of which is incorporated by reference herein, and U.S. Provisional Application No. 61/624,015, filed Apr. 13, 2012, the contents of which is also incorporated by reference herein.

TECHNICAL FIELD

The following summary and descriptions relate to the deposition of encapsulated fragrance on containers used to store food and beverages.

BACKGROUND

Much of what is attributed to taste is actually a function of smell. By enhancing the smell of a food or beverage, the perceived taste and other experiences associated with that food or beverage may be affected. For example, a person eating a chocolate bar while smelling mint may perceive that the chocolate bar has mint flavoring even if it does not have mint flavoring.

Scratch and sniff type aroma releases are well known. ScentSational Technologies, LLC of Jenkintown, Pa. markets an FDA-approved food grade FEMA-GRAS (Generally Recognized As Safe) flavors directly into food and beverage packaging components and fragrances into consumer products packaging under the tradename Encapsulated Aroma Release™ technology. It is believed to encapsulate a fragrance is a friable microcapsule. In this regard, the packaging becomes aromatized to enhance the product and overall consumer experience. ScentSational lists that their technology can be applied to all existing manufacturing methods, including blow molding, injection molding, thermoforming, extrusion and in gaskets and liners.

It has been suggested that beverage companies apply a microcapsule type fragrance to the exterior of a beverage can after filling, without specificity to its location on the can.

SUMMARY

The use of fragrance on food and beverage containers may enhance the perceived experiences of those food and beverages. In order to control the timing of fragrance delivery, fragrance may be encapsulated in microcapsules. In one embodiment, a can end, such as a can end configured for use on a food or beverage can may comprise a peripheral curl configured to be seamed to a can body flange, a center panel disposed within the peripheral curl, a tab coupled to the center panel by a rivet, and fragrance encapsulated in microcapsules, the microcapsules being positioned such that actuation of the tab activates as least a portion of the microcapsules to release the fragrance.

In another embodiment, a can assembly may comprise fragrance encapsulated in microcapsules, a can body, and a can end seamed to the can body, the can end further comprising a peripheral curl seamed to the can body, a center panel, and a tab coupled to the center panel by a rivet.

In another embodiment, a metal container may comprise a body, a foil cover sealed to the body having an outer surface and a tab configured for use in detaching the foil from the body, and fragrance encapsulated in microcapsules.

Another embodiment may comprise a metal container comprising a lid, a body, and fragrance encapsulated in microcapsules.

Another embodiment may comprise an aerosol container comprising a valve outlet with a button, a product compartment attached to the valve outlet, and fragrance encapsulated in microcapsules.

In another embodiment, a bottle assembly comprising a bottle including a neck that defines an opening, a crown cap configured to cover the opening, and fragrance encapsulated in microcapsules located in an opener-contact region.

BRIEF DESCRIPTION OF THE DRAWINGS

The foregoing summary, as well as the following detailed description of the various embodiments of the application, will be better understood when read in conjunction with the appended drawings. For the purposes of illustrating the various embodiments of the disclosure, reference is made to the drawings. It should be understood, however, that the application is not limited to the precise arrangements and instrumentalities illustrated in the drawings, in which.

DETAILED DESCRIPTION OF ILLUSTRATIVE EMBODIMENTS

Figure 13:
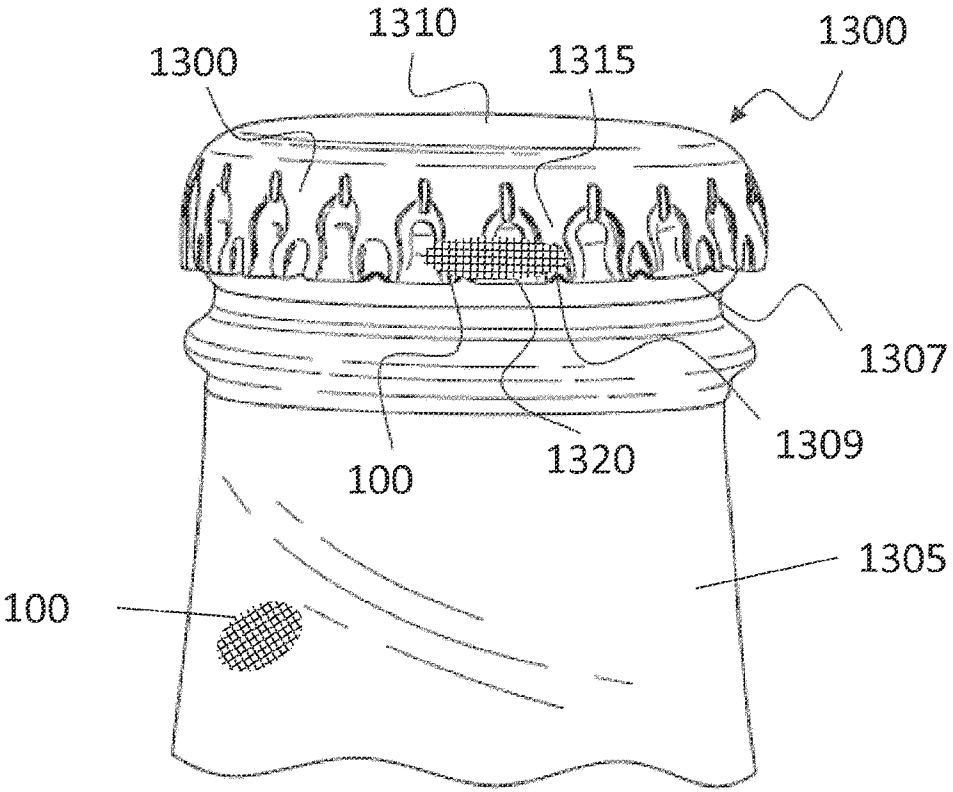
FIG. 13 is a perspective view of a bottle including a crown cap with portions of the bottle cut away.
Figures 14A, 14B:
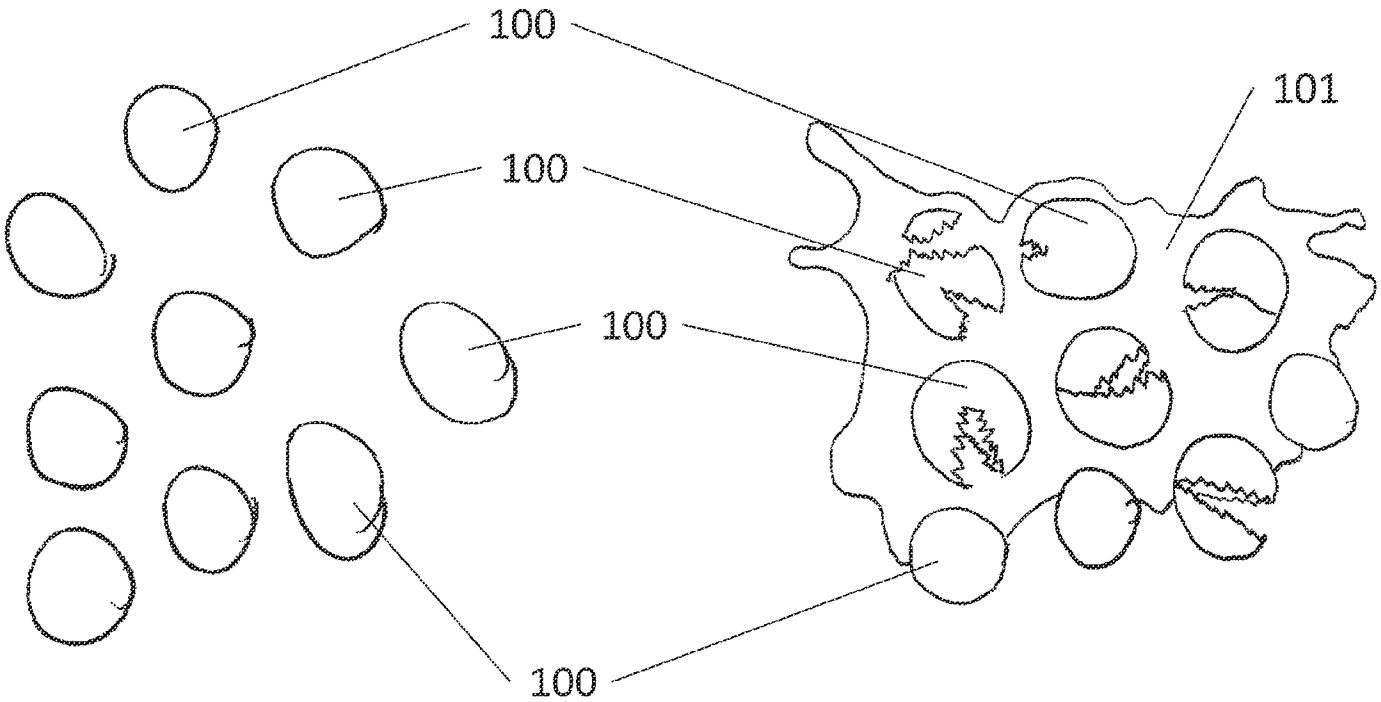
FIG. 14A is a magnified top view of microcapsules that contain fragrance emitting oil wherein the microcapsules are in an unruptured state.
FIG. 14B is a magnified top view of the microcapsules shown in FIG. 14A wherein the majority of the microcapsules are in a ruptured state and the fragrance emitting oil has been released.

The following description relates to the use of microcapsules 100, such as the microcapsules 100 shown in FIGS. 14A, B, on containers such as those shown in FIGS. 1A-13. Microcapsules 100 contain fragrance emitting substance 101, that includes fragrance such as fragrance oil. Microcapsules 100 may be any type of microcapsules configured to contain fragrance emitting substance 101, such as fragrance oil or essential oil. The containers, microcapsules, and fragrance emitting substance 101 may each be configured so that an end user of the container smells the fragrance emitting substance 101 at some point while using the container or the contents of the container.

Microcapsules 100 are configured so that, upon application of force, the microcapsules rupture and fragrance emitting substance 101 is released from the microcapsules. Force may be applied to the microcapsules 100 in a variety of ways. For example, a user of a container may directly touch the microcapsules 100 on the container so as to abrade the microcapsules 100 in a generally linear manner or so as to create an axial force that crushes the microcapsules. These types of forces created, for example, by the user's finger, may cause the microcapsules 100 to sheer, exposing the fragrance emitting substance 101 to the user's skin. By contacting the user's skin, the fragrance emitting substance 101, such as oil, may mix with oil on the user's skin, so as to enhance the user's perception of the smell of the fragrance emitting substance 101. Alternatively, force may be applied to the microcapsules indirectly by the user, such as during an opening process of the container. For example, during the opening process of the container, two parts of the container may move relative to one another, sheering microcapsules on either or both parts of the container and releasing fragrance emitting substance 101. Microcapsules 100 may also release fragrance emitting substance 101 without force being applied. For example, the outer shells of the microcapsules 100 may break spontaneously or dry out after a given amount of time.

Microcapsules 100 may be deposited on the surfaces of the container 10 for rupturing before, during, and/or after opening by a user. The following examples of the locations of microcapsules 100 are not intended to be limiting. It will be appreciated that embodiments may be configured such that there is minimal rupture of the microcapsules prior to consumer use so as to minimize fragrance exposure during manufacture, as well as during transportation and at point of sale. In some embodiments, microcapsules 100 may be applied to the container during late-stage manufactures, such as after filling of the container. Further, it will be appreciated that embodiments will encompass microcapsules that are located at one location or more than one location on the container 10.

Figure 1B:
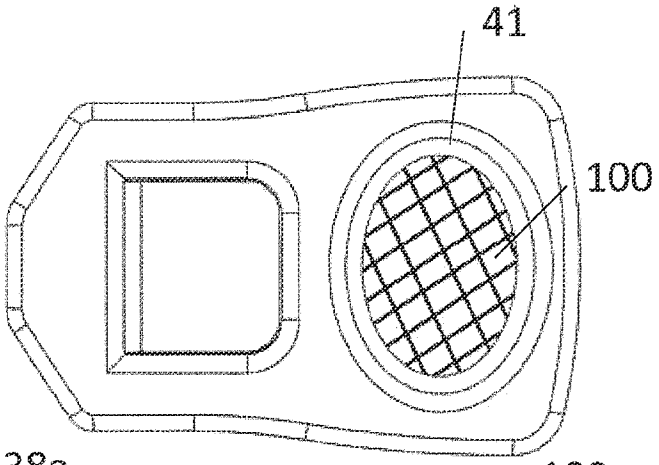
FIG. 1B is a top view of the beverage can tab shown in FIG. 1A.
Figure 1C:
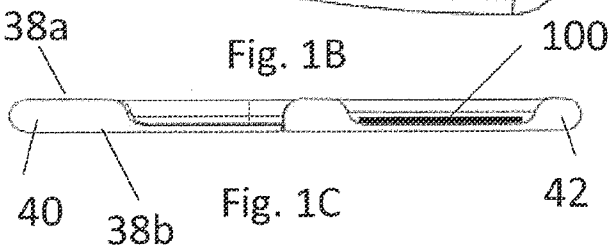
FIG. 1C is a cross-sectional view the beverage can tab shown in FIGS. 1A, B.
Figure 1D:
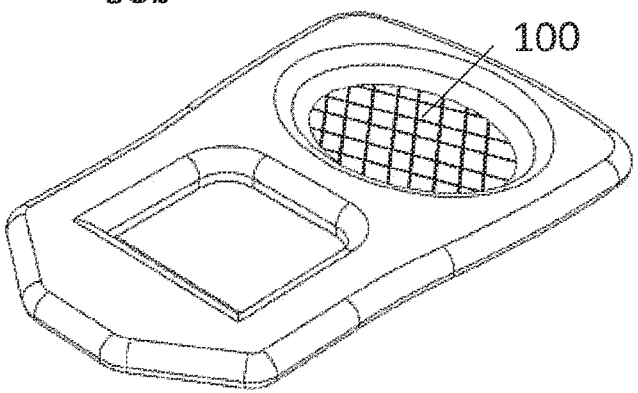
FIG. 1D is a perspective view of the beverage can tab shown in FIGS. 1A-C.
Figure 1A:
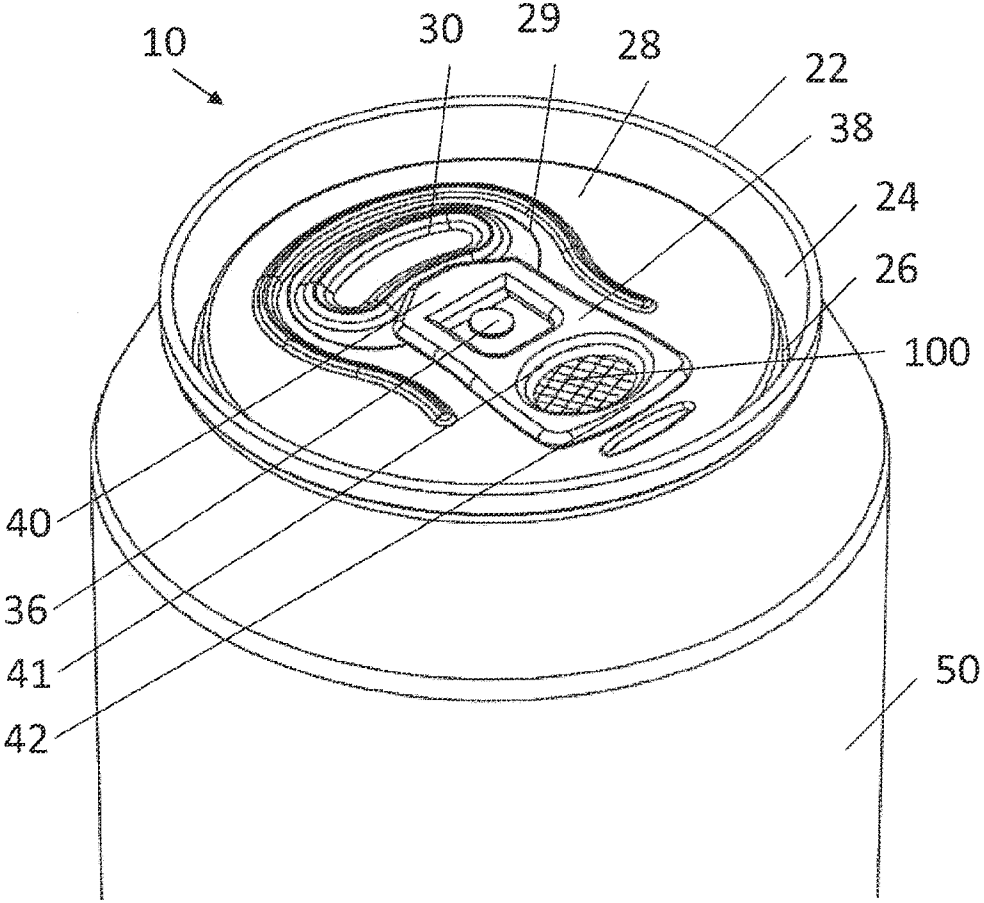
FIG. 1A is a perspective view of a beverage can including a tab with portions of the can body cut away.
Figure 7B:
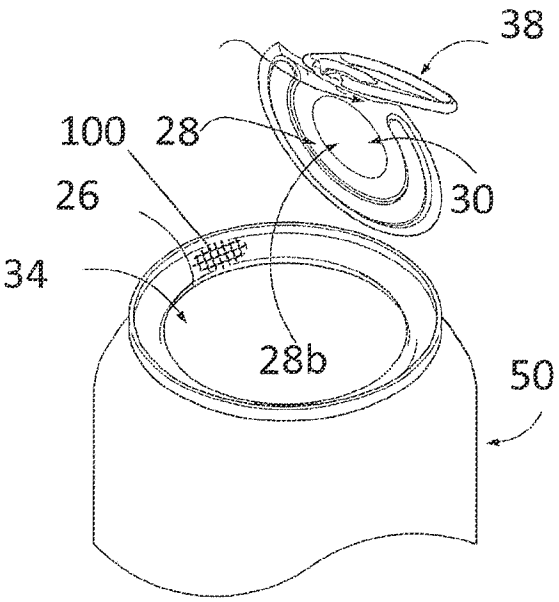
FIG. 7B is a perspective view of the beverage can shown in FIG. 7B with portions of the can body cut away.
Figure 7A:
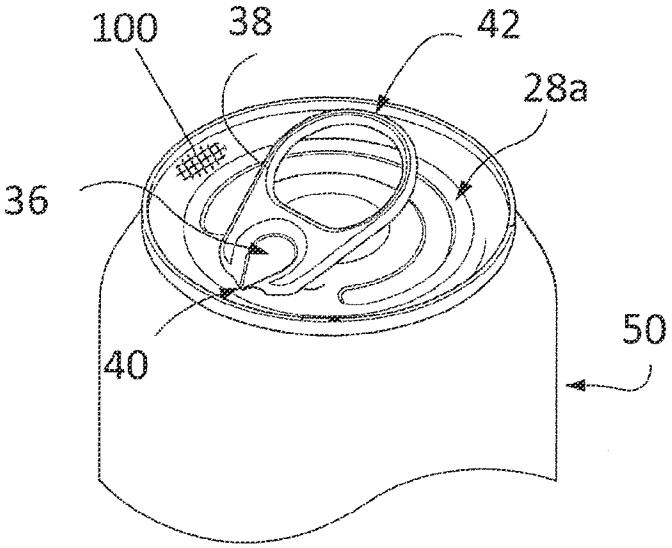
FIG. 7A is a perspective view of a beverage can with portions of the can body cut away.
Figure 8B:
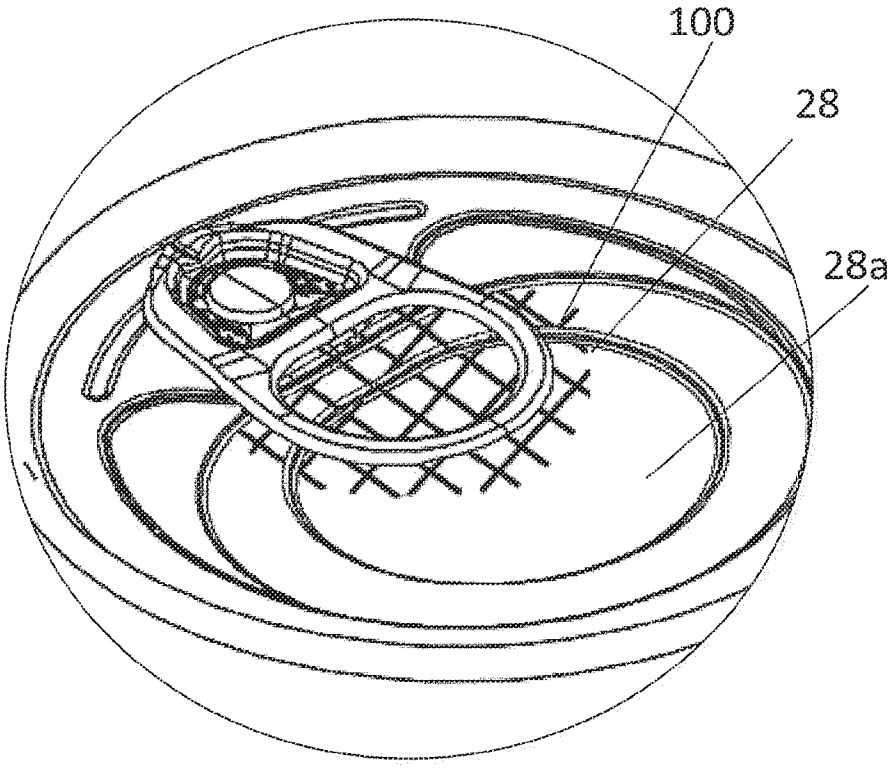
FIG. 8B is a magnified partial perspective view of Section C of the food can shown in FIG. 8A.
Figure 8A:
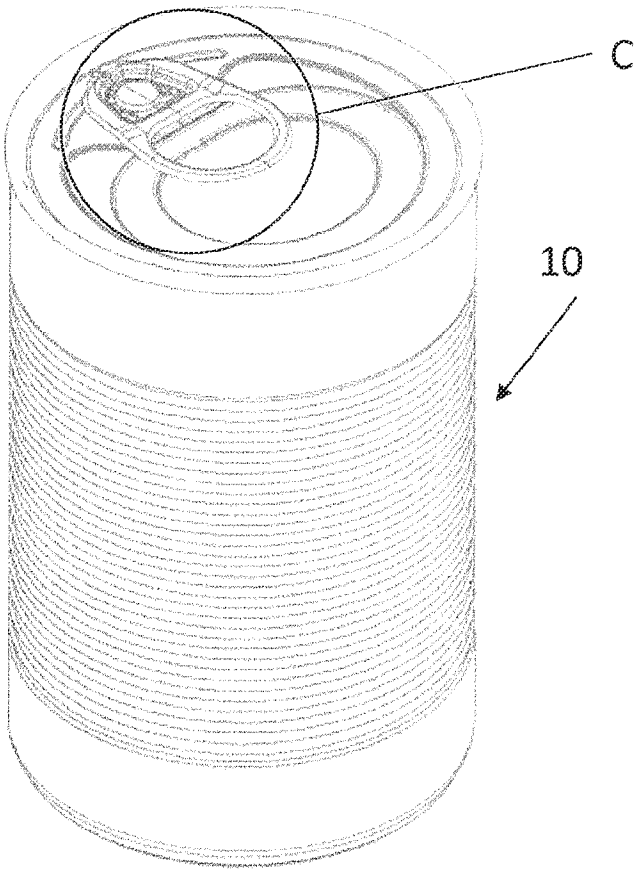
FIG. 8A is a perspective view of a food can.

FIG. 1A shows a container 10, such as a metal beverage can assembly that includes a can end 20 and a can body 50. The can end 20 has an outwardly extending peripheral curl 22 seamed to a can body flange. The peripheral curl 22 connects to an inwardly extending chuck wall 24. A countersink bead 26 connects chuck wall 24 to center panel 28. Center panel 28 has an outer surface 28*a* and an opposed inner surface 28*b* (as shown in FIGS. 7A, B).

The center panel 28 further comprises a score 29 that defines a tear panel 30. Score 29 further defines a score recess 32 (shown in FIG. 5B). As shown in FIGS. 2A, 7B tear panel 30 may be configured to partially or fully detach from the center panel 28 to form a pour opening 34.

Center panel 28 may comprises a rivet 36 that attaches a tab 38 to the center panel 28. The tab 38 has a top side 38*a* and a bottom side 38*b*. Tab 38 is further configured to have a nose 40 and a heel 42. The rivet 36 acts as a pivot point for the tab such that when the heel 42 is lifted, the nose 40 is configured to slidingly engage the tear panel 30, pressing downward on the tear panel 30 and straining the score 29 such that the score 29 begins to rupture and the pour opening 34 begins to form.

Figure 2B:
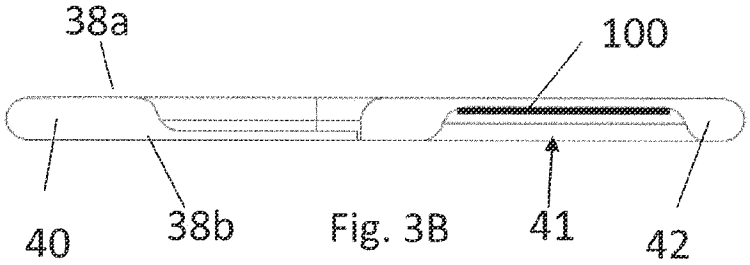
FIG. 2B is a cross sectional view of the tab shown in FIG. 2A.
Figure 2A:
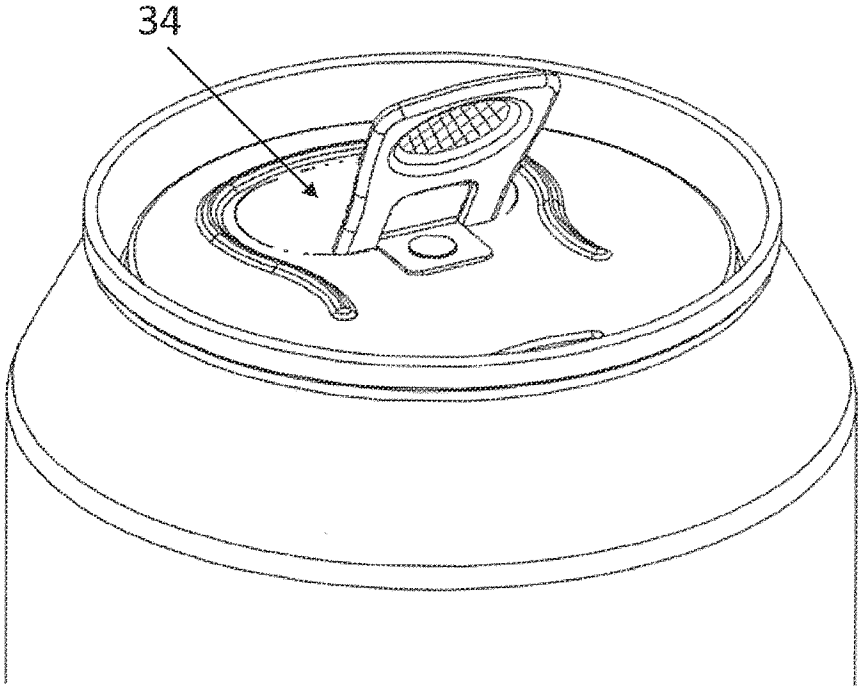
FIG. 2A is a perspective view of a beverage can including a tab with portions of the can body cut away.

In some exemplary embodiments, as shown in FIGS. 1A-2B, microcapsules 100 may be located on tab 38. For example, tab 38 may include a tab well 41 between the tab heel 42 and nose 40. The tab well 41 may be a recessed portion of either the top side 38*a* (as shown in FIG. 1C) or the bottom side 38*b* (as shown in FIG. 2B) of the tab 38. Tab well 41 may contain microcapsules 100. By depositing microcapsules on the bottom side 38*b* of the tab 38, microcapsules may be protected from incidental rupture prior to container opening by the user, such as an end consumer. The user may access the contents of the container by prying the heel 42 of the tab away from the center panel 28 with his fingers. During this process, the user's fingers create a force against the microcapsules 100 on the tab 38, axially and/or linearly relative to the top side 38*a* and/or bottom side 38*b* of the tab. The axial and/or linear force(s) breaks microcapsules 100, releasing fragrance emitting substance 101.

Figure 3B:
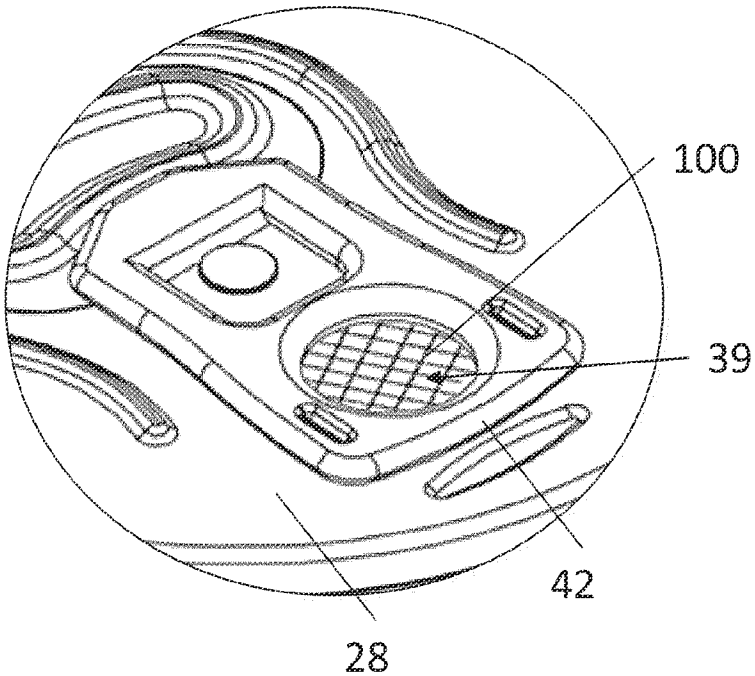
FIG. 3B is a magnified partial perspective view of Section A of the beverage can shown in FIG. 3A.
Figure 3A:
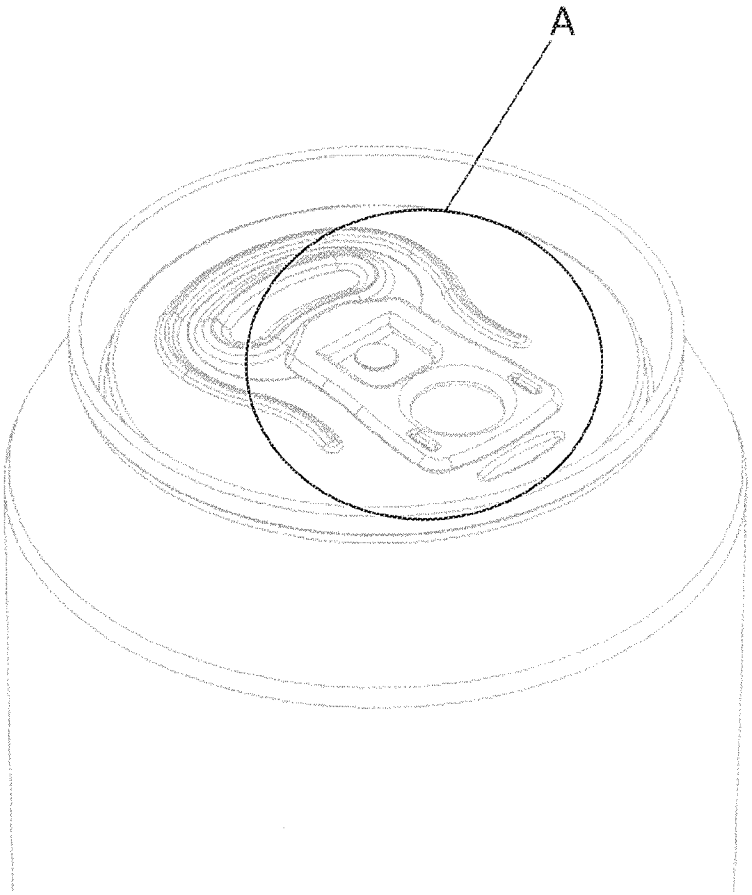
FIG. 3A is a perspective view of a beverage can with portions of the can body cut away.

Some exemplary embodiments include microcapsules 100 on the outer surface 28*a* of the center panel 28. For example, as shown in FIG. 3, tab 38 does not include a tab well 41 and instead includes a tab cut-out 39. Cut-out 39 exposes a portion of the center panel 28 that is otherwise be covered by the tab 38. This exposed portion may be partially or completely covered with microcapsules 100. Microcapsules 100 may be arranged on the center panel 28 so that as a user pivots the tab 38 by sliding a finger under the heel 42, microcapsules 100 rupture due to the generally linear abrasion force created by the user's finger sliding motion and fragrance emitting substance 101 is released.

Figure 4B:
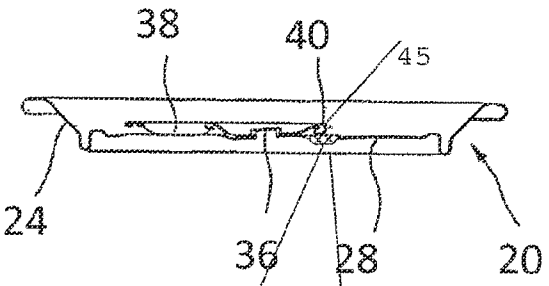
FIG. 4B is a cross-sectional view of the can end shown in FIG. 4A in an unseamed state.
Figure 4A:
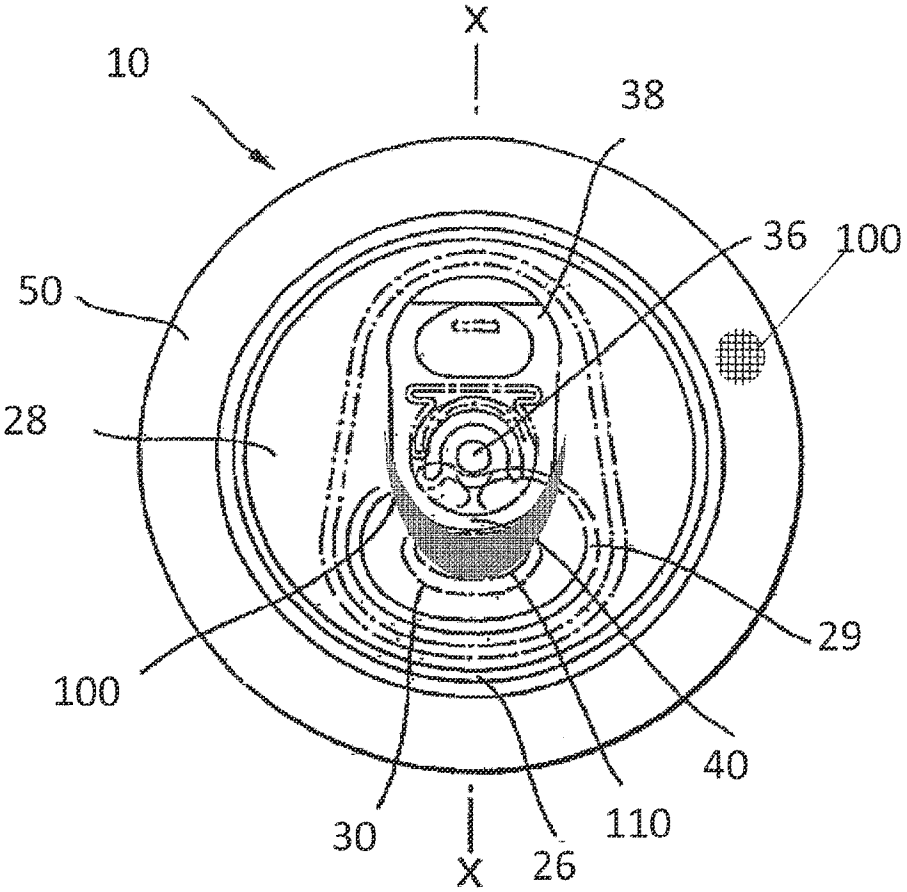
FIG. 4A is a top view of a beverage can including a seamed can end.

As shown in FIG. 4A, some embodiments may include microcapsules 100 that are deposited in the form of a ring 110 (shown partially) on the center panel 28 around rivet 36. Such a ring 110 may have various geometries including the circular geometry shown in FIG. 4A. In one embodiment, the ring 110 has a diameter in the range of 8-10 mm. The configuration of a ring 110 enables application of microcapsules 100 without orienting the end. The microcapsules 100 of the ring 110 may be sheered by contact with the nose 40 of the tab 38 during opening. The microcapsules 100 may alternatively or additionally be sheered when the user slides a finger underneath the tab 38 during opening.

In some embodiments, microcapsules 100 may be located on the nose 40 of the tab 38 or on the center panel 28 underneath the nose 40 such that during opening, contact between the tab 38 and the center panel 28 causes the microcapsules to break. Some embodiments include a nose recess 45 that provides a housing for microcapsules 100. During opening, the nose recess 45 may be compressed, so as to crush the microcapsules 100, releasing the fragrance emitting substance 101. Some embodiments include a tear panel recess 44 defined by the tear panel and providing a housing for microcapsules 100. Microcapsules 100 in the tear panel recess 44 may be compressed and crushed during opening when the nose 40 presses against the tear panel so as to release the fragrance emitting substance 101. It will be appreciated that microcapsules 100 may have other locations on the can end 20 in addition to those shown. Additionally, microcapsules 100 may be located on the can body 50.

Figure 5B:
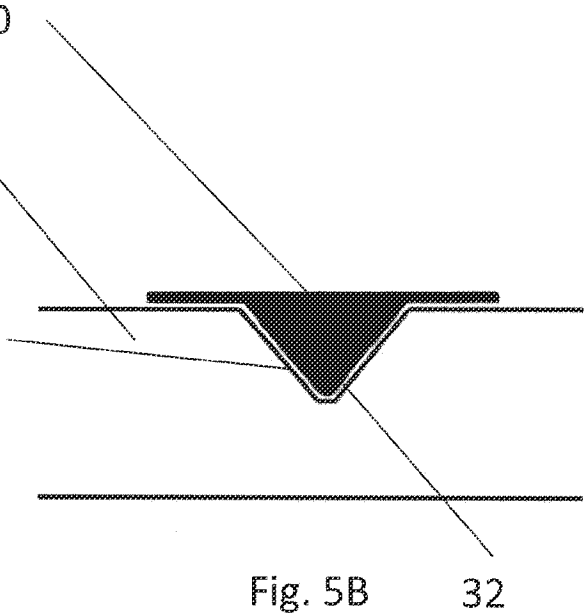
FIG. 5B is a cross-sectional view of the score of the can end shown in FIG. 5A.
Figure 5A:
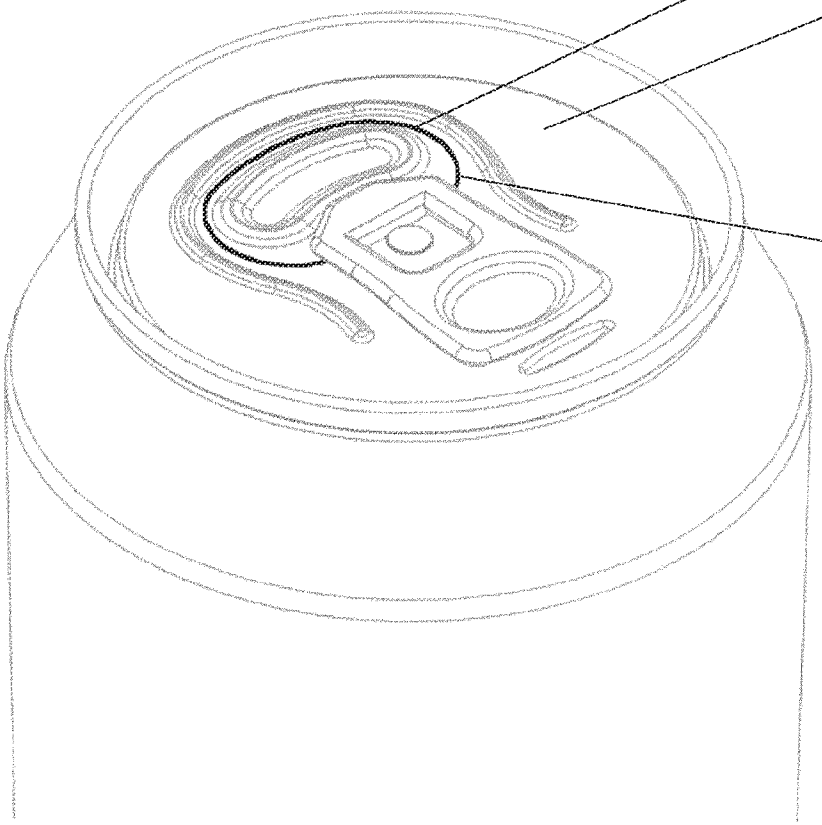
FIG. 5A is a top perspective view of a can end including a score.
Figure 6B:
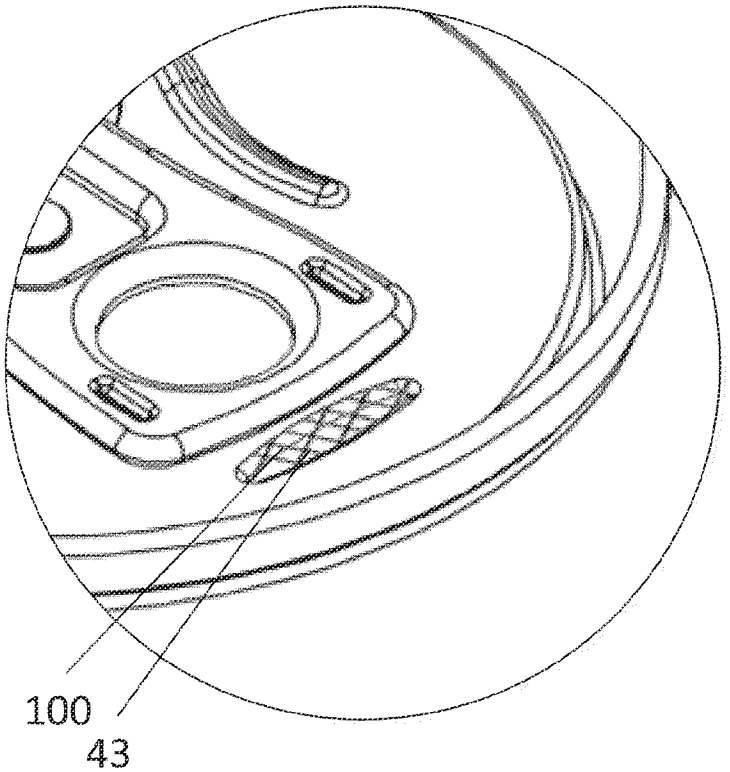
FIG. 6B is a magnified partial perspective view of Section B of the beverage can shown in FIG. 6A.
Figure 6A:
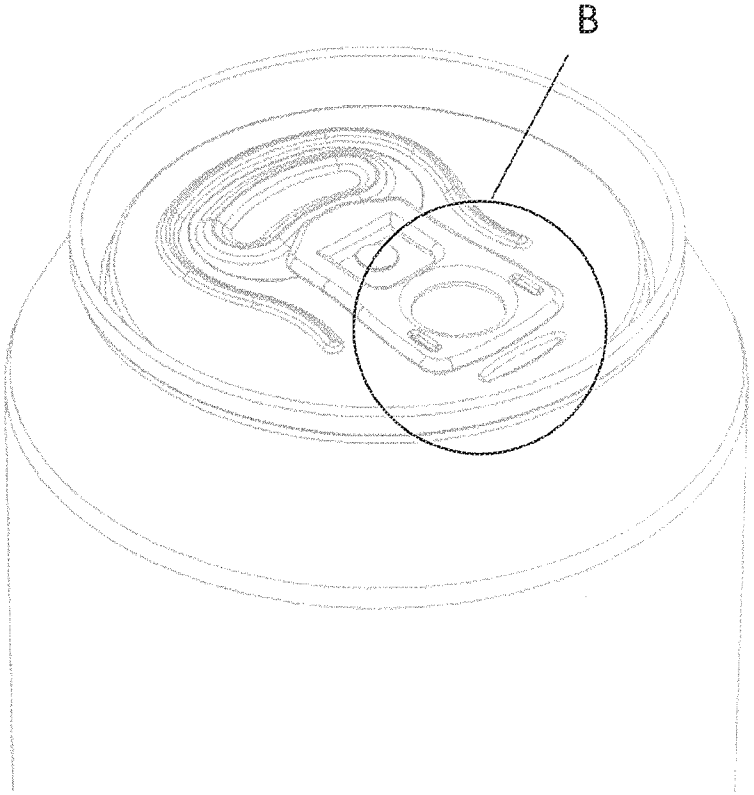
FIG. 6A is a perspective view of a beverage can with portions of the can body cut away.

Microcapsules 100 may also be located in the recess 32 defined by the score 29. FIGS. 5A, B shows microcapsules 100 deposited in the score recess and on outer surface 28*a* of the center panel 28. When the score 29 ruptures, microcapsules 100 in the score recess are crushed and sheered against one another, releasing the fragrance emitting substance 101. Center panel 28 may further include other recesses, such as heel recess 43 shown in FIG. 6B. Recess 43 may be partially or completely filled with microcapsules 100. When the user places a finger underneath the tab 38, his finger also contacts microcapsules 100 in the recess 43, compressing and/or linearly sheering the microcapsules 100 so as to release the fragrance emitting substance 101.

Other types of containers 10 may also include microcapsules 100. For example, FIGS. 7A, B show a beverage can in which the tear panel 30 comprises a majority of the center panel 28. Microcapsules 100 may be located on multiple surfaces on container 10, including the chuck wall 24, as shown in FIGS. 7A, B.

Other types of containers 10, such as food cans, may also include microcapsules. For example, FIGS. 8A, B show a container 10 with microcapsules 100 on the outer surface 28*a* of the center panel 28.

Figure 9:
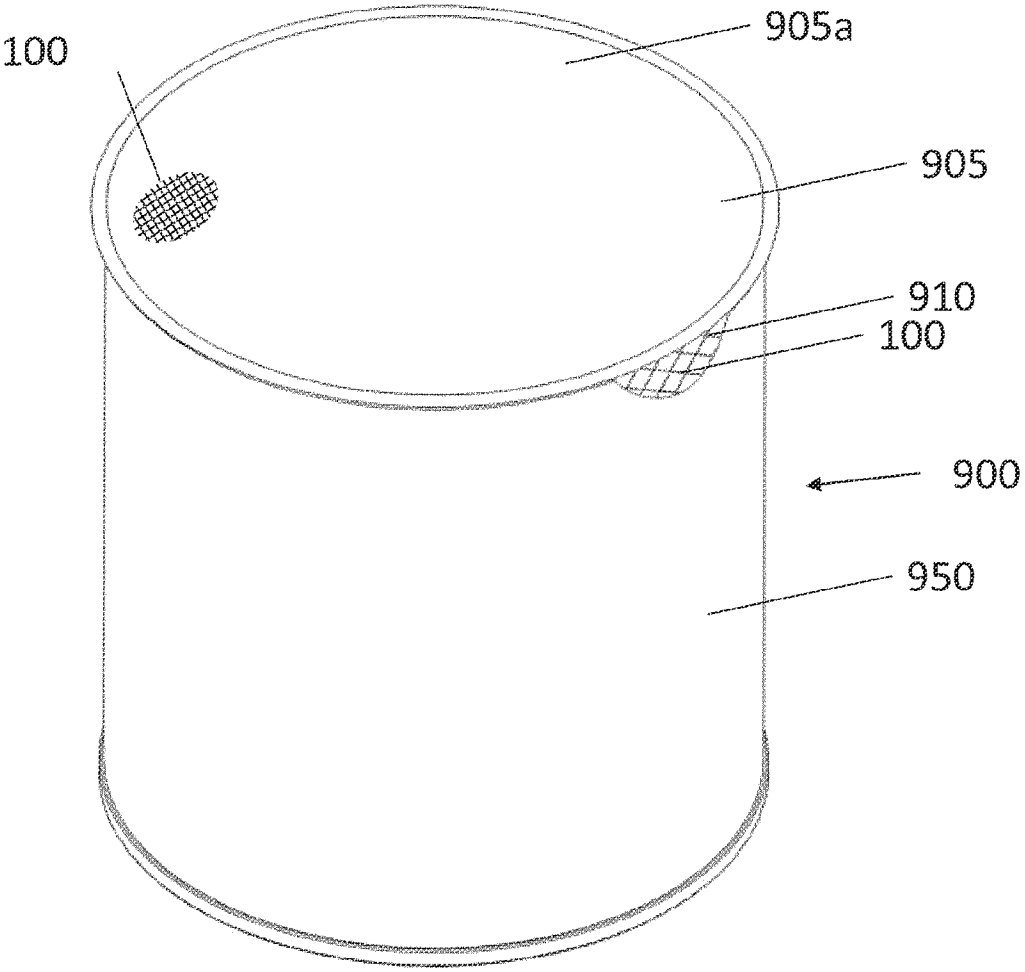
FIG. 9 is a perspective view of a metal container including a foil cover.

Microcapsules 100 may also be deposited on other types of containers. FIG. 9 shows a metal container 900 including a metal container body 950 attached to a peel-off foil 905. In some embodiments, metal container 900 includes a lid (not shown). Foil 905 includes a tab 910 for peeling off foil 905 from the metal container 900. Tab 910 may include microcapsules 100 such that when a user pulls the tab 910 to remove the foil, axial force is applied to microcapsules 100 by the user's fingers as the fingers squeeze the tab 910 so that they shatter and fragrance emitting substance 101 is released.

Microcapsules 100 may be located on numerous other locations on metal container 900. For example, microcapsules 100 may be located on an outer surface of the foil 905*a* such that, as the foil is peeled from the metal container 900 and the foil 905 is subsequently bent and/or stretched, the microcapsules 100 shatter, releasing fragrance.

Figure 10B:
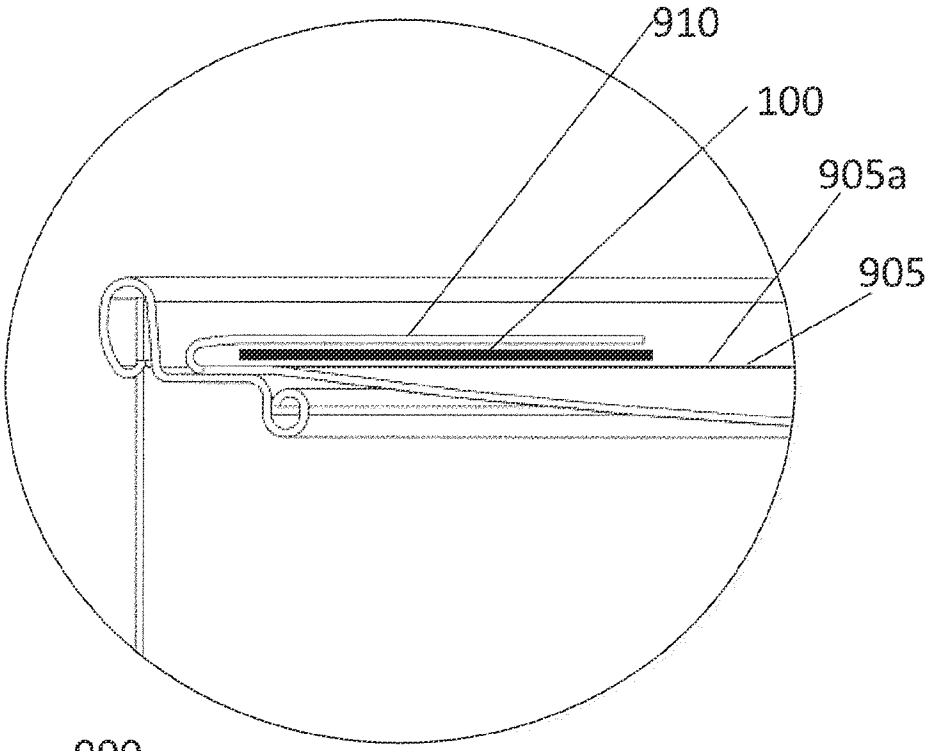
FIG. 10B is a magnified partial cross-sectional view of the metal container shown in FIG. 10A.
Figure 10A:
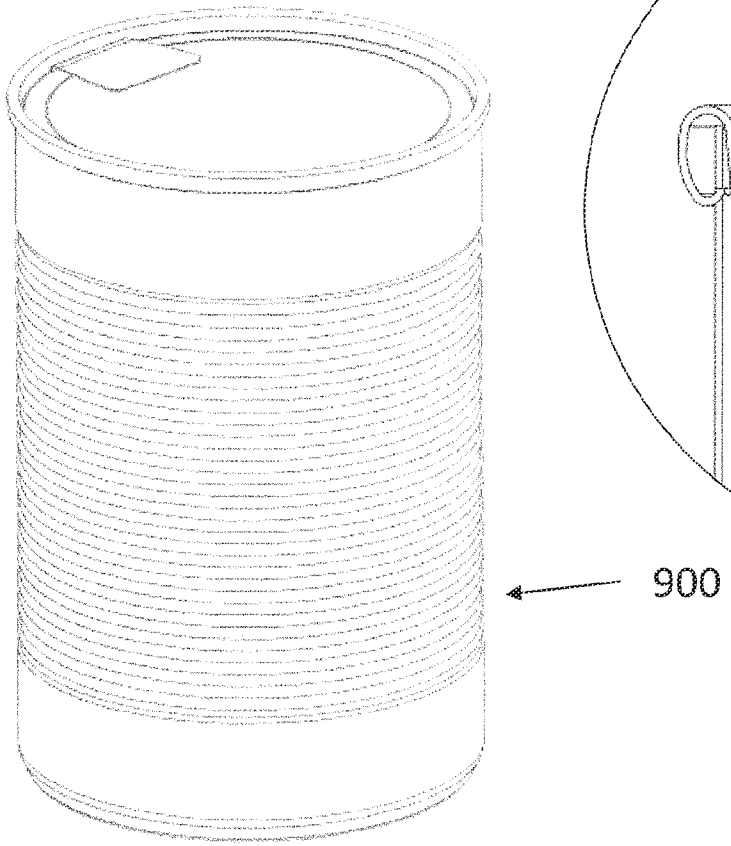
FIG. 10A is a perspective view of a metal container including a foil cover.
Figure 11:
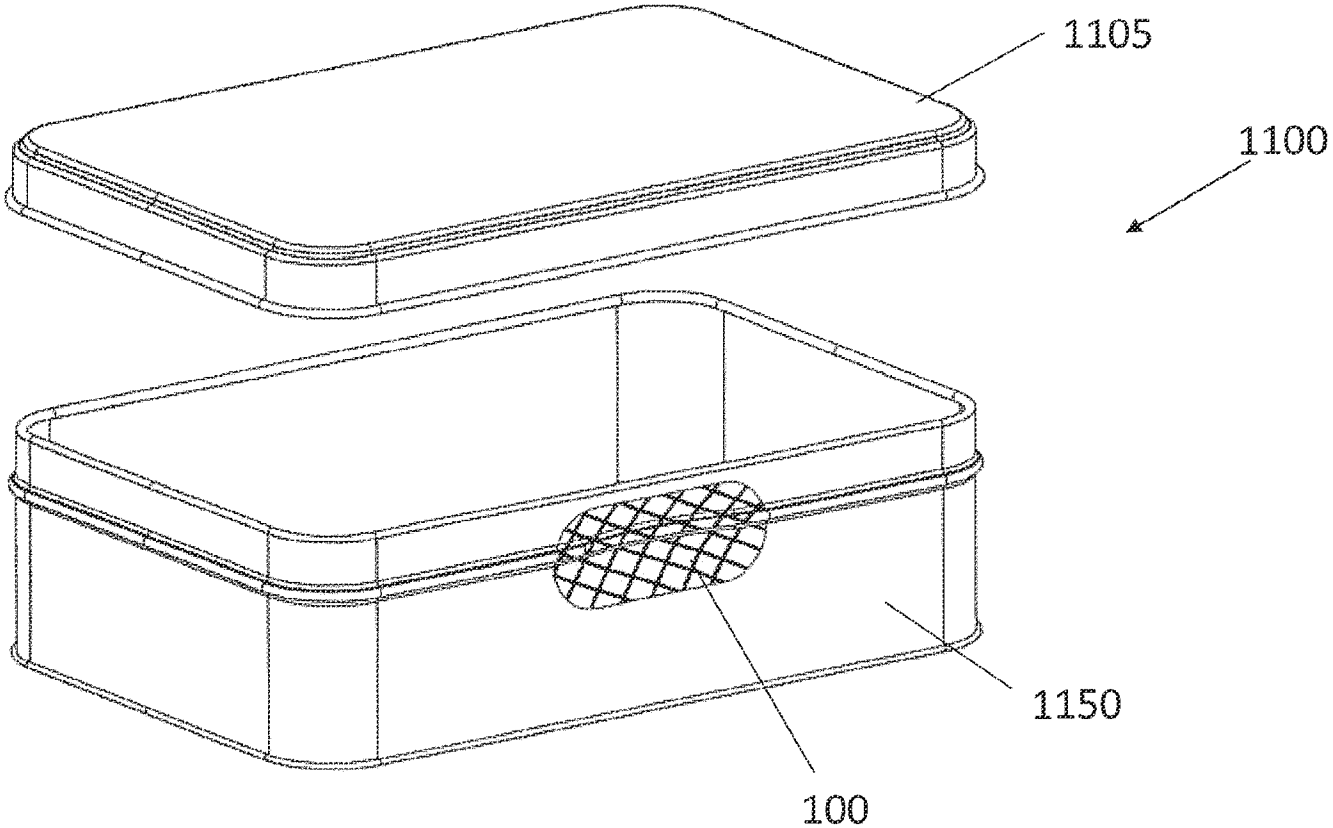
FIG. 11 is a perspective view of a metal container including a metal lid.

Some embodiments, such as the metal container 900 shown in FIGS. 10A, B, may include microcapsules 100 in between the tab 910 and the outer surface 905*a* of the foil 905. As the tab 910 is pulled away from the outer surface 905*a* of the foil 905, the capsules are sheered apart and/or against one another so as to release the fragrance emitting substance.

Other types of metal containers that may be used for the deposition of microcapsules 100 include a metal container 1100 (shown in FIG. 11) with a metal lid 1105 that attaches to metal container body 1150. Metal container 1100 may include microcapsules 100 on the body 1150 that are configured to be ruptured as the lid 1105 is removed from the body 1150. Specifically, as the lid 1105 slides against the body 1150, linear abrasion ruptures the microcapsules 100, releasing fragrance emitting substance 101.

Figure 12B:
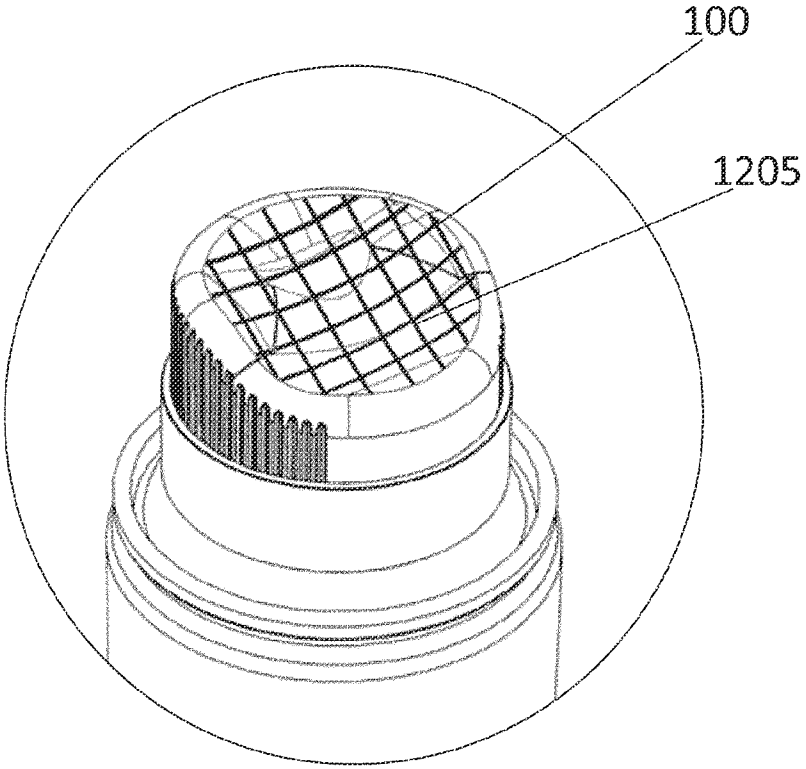
FIG. 12B is a magnified perspective view of the aerosol container shown in FIG. 12A with portions cut away.
Figure 12A:
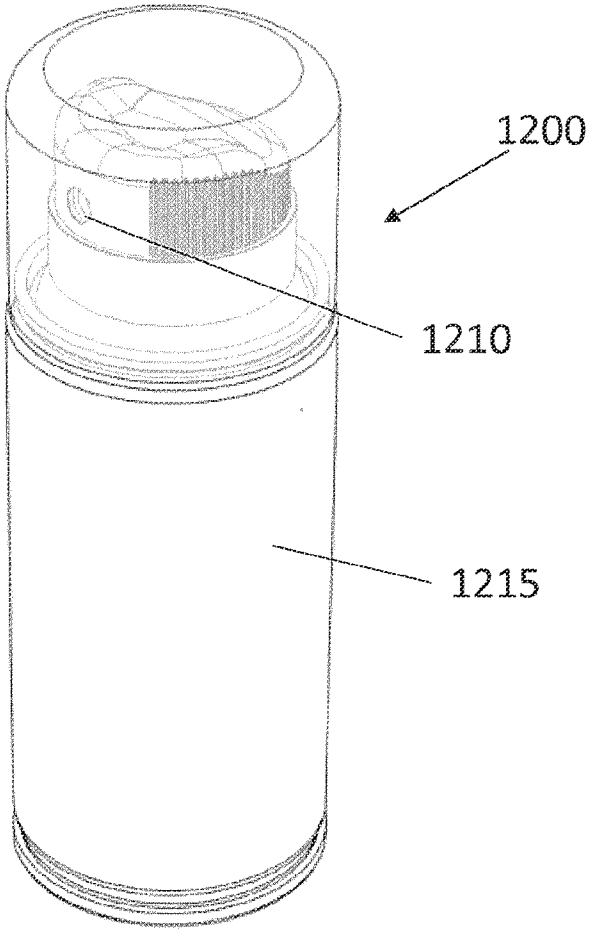
FIG. 12A is a perspective view of an aerosol container.

Containers such as the aerosol container 1200 shown in FIGS. 12A, B may also include microcapsules 100. Aerosol container 1200 includes a product compartment 1215 that connects to a valve outlet 1210 which is controlled by an actuator button 1205. Actuator button 1205 may be made of various types of material including metal and plastic. In some embodiments, microcapsules 100 may be deposited on the actuator button 1205 as shown in FIG. 12B. In this way, when the user applied pressure to the actuator button 1205 so as to actuate the valve outlet 1210, axial force (and alternatively or additionally linear abrading force) breaks the microcapsules 100, releasing fragrance emitting substance 101.

FIG. 13 shows a bottle assembly 1300 with portions cut away. The embodiment shown is a glass bottle 1305, but it will be appreciated that bottle 1305 may be made of various types of other materials such metal. Bottle 1305 includes a neck 1307 that defines an opening (not shown) through which the contents of the bottle 1305 may be dispensed. A crown cap 1310 is configured to cover the opening. Crown cap 1310 includes a skirt 1315 that has a bottom edge 1309. The crown cap 1315 may be a pry-off or twist-off type cap.

Microcapsules 100 may be located on numerous locations on bottle assembly 1300. For example, microcapsules 100 may be located in on the neck 1307 of the bottle 1305 in a region where the bottle may be held during consumption of the contents. As the user holds the bottle 1305, pressure and/or linear abrasion may crush the microcapsules 100, releasing fragrance emitting substance 101. Some embodiments may include microcapsules on an opener-contact region 1320 of the bottle assembly 1300 such as a location on the bottle assembly 1300 where a user contacts the bottle assembly with a hand or bottle opener to pry or twist the crown cap 1310 from the bottle 1305. In some embodiments, the bottom edge 1309 of the skirt 1315 may include microcapsules. The users hand and/or the bottle opener may crush the microcapsules 100, releasing the fragrance emitting substance 101 during the opening process.

The forgoing descriptions are not intended to be limiting both in terms of locations of microcapsules and container types. For example, microcapsules 100 may be located anywhere on container 10, including portions not shown such as the base. Also, microcapsules 100 may be deposited on container types such as resealable cans or glass jar lids.

Microcapsules 100 are configured to rupture at various times. It will be appreciated that some microcapsules may rupture prior to being deposited on a container 10, 900, 1100, 1200, 1300. Some microcapsules may rupture after deposition on the container but prior to use by the end consumer. The container, microcapsules, and fragrance may be configured so that at least a portion of the microcapsules rupture at at least one a key time in the life-cycle of the container. For example, containers and microcapsules may be configured so that microcapsules rupture when the end consumer opens the container. Microcapsules may also rupture after opening, so fragrance may be continually released while the contents of the container is consumed. It will be appreciated that the designs of the container, the microcapsules, including the microcapsule coating, and the fragrance may all be configured so that the end consumer experiences fragrance at an appropriate time in the life-cycle of the container.

In one example, a beverage can may be configured to contain beer. The can may include microcapsules with fragrance that smells like savory food that may be served with the beer. In this way, the end consumer may enjoy a beer with a perceived taste that complements a meal.

In other embodiments, the microcapsules may contain fragrance that may otherwise modify the perceived taste of the contents of the container. For example, cherry fragrance may be used so that the end user perceives regular cola as tasting like cherry flavored cola.

In addition to modifying perceived tastes, the microcapsules may be used to otherwise effect the consumer experience. In one exemplary embodiment, a can containing soup may have microcapsules with fragrance that smells like meat so that the end consumer may perceive the soup to have an abundance of meat. In other exemplary embodiments, fresh vegetable or herb fragrance may be encapsulated so that the end consumer may attribute qualities to the contents of the container.

Some embodiments may include microcapsules that have two or more fragrances. In such embodiments, at least two types of fragrance emitting oil may be separately encapsulated in different microcapsules. The at least two groups of microcapsules may then be combined and affixed to a container. In one embodiment, a can of regular flavor cola may have microcapsules with cherry fragrance and microcapsules with vanilla fragrance. The end user of such a product may perceive the regular flavor cola as having a cherry vanilla cola flavor.

In some embodiments, microcapsules 100 and the fragrance emitting substance 101 contained therein may be suitable for human consumption. These embodiments may include containers that have microcapsules deposited in areas where the microcapsules and fragrance emitting oil may contact the contents of the container and/or be consumed by the end user.

Some embodiments may be configured so that the microcapsules change color when ruptured. For example, microcapsules may be configured to display a first color, such as white, when less than a majority of the microcapsules a ruptured and a second color, such as red, when a majority of the microcapsules are ruptured.

For the embodiments described herein, various types of application methods may be used to apply microcapsules to cans and containers. For example, microcapsules may be dispersed in a lacquer or ink that is coated on a can or container during the manufacturing process. In some embodiments, cans or containers may be spot coated with a lacquer or ink that contains microcapsules during or following formation of the container. Alternatively, microcapsules may be sprayed on to a can or container such that the microcapsules form a film that dries or is cured on the substrate of the container.

In yet another embodiment, pad or tampo printing may be used to apply the microcapsules to a can or container. Pad printing involves transferring a 2-D image onto a 3-D object by using an indirect offset printing process. Specifically, an image may be transferred from the cliché via a silicone pad onto a substrate. Properties of the silicone pad enable it to pick the image up from a flat plane and transfer it to a various surfaces such as those shown in the cans and containers herein.

What is claimed:

1. A can end comprising a peripheral curl configured to be seamed to a can body flange;

a center panel disposed within the peripheral curl;

a tab coupled to the center panel by a rivet; and fragrance encapsulated in microcapsules, the microcapsules disposed on at least one of the center panel and the tab, the microcapsules being positioned and adapted such that actuation of the tab activates at least a portion of the microcapsules to release the fragrance.

2. The can end of claim 1 wherein the microcapsules are positioned so as to release the fragrance onto a user's skin during opening.

3. The can end of claim 1 wherein the at least a portion of the microcapsules are on a nose of the tab.

4. The can end of claim 1 wherein the microcapsules encapsulate at least two different fragrances.

5. The can end of claim 1 wherein the at least a portion of the microcapsules are on a heel of the tab.

6. The can end of claim 1 wherein the center panel further comprises a score which defines a recess and the at least a portion of the microcapsules are in the recess.

7. The can end of claim 1 wherein the center panel defines a recess that is at least partially filled with the at least a portion of the microcapsules.

8. The can end of claim 1 wherein the microcapsules have a first color when less than 50 percent of the microcapsules are ruptured and a second color when more than 50 percent of the microcapsules are ruptured.

9. The can end of claim 1 wherein the at least a portion of the microcapsules are on the center panel.

10. The can end of claim 9 wherein the at least a portion of the microcapsules form a ring about the rivet.

11. The can end of claim 1 wherein the at least a portion of the microcapsules are located on the center panel at a heel of the tab.

12. The can end of claim 11 wherein the at least a portion of the microcapsules are located in a recess, the recess being disposed at the heel of the tab.

13. The can end of claim 1 wherein the center panel includes a tear panel formed therein, the at least a portion of the microcapsules being located on the tear panel beneath a nose of the tab such that the nose is capable of activating the at least a portion of the microcapsules upon activation of the tab.

14. The can end of claim 13 wherein the tab and tear panel are configured such that the nose slidingly engages the tear panel to activate the microcapsules upon actuation of the tab.

15. The can end of claim 13 wherein the tear panel has a recess for housing the at least a portion of the microcapsules.

16. A can assembly comprising fragrance encapsulated in microcapsules;

a can body; and a can end seamed to the can body, the can end further comprising a peripheral curl seamed to the can body;

a center panel; and a tab coupled to the center panel by a rivet;

wherein the microcapsules are positioned and adapted so that as a user actuates the tab, the microcapsules release the fragrance onto the user's skin.

17. The can assembly of claim 16 wherein the microcapsules are located on the tab.

18. The can assembly of claim 16 wherein the microcapsules are located on a tear panel of the center panel.

19. The can assembly of claim 16 wherein the microcapsules are located in a score that forms a tear panel of the center panel.

20. The can assembly of claim 16 wherein at least a portion of the microcapsules are located beneath a nose of the tab.

21. The can assembly of claim 16 wherein at least a portion of the microcapsules are on a nose of the tab.

22. The can assembly of claim 16 wherein at least a portion of the microcapsules are on a heel of the tab.

23. The can assembly of claim 16 wherein at least a portion of the microcapsules are located on the center panel beneath a heel of the tab.

24. The can end of claim 23 wherein the at least a portion of the microcapsules are located in a recess, the recess being disposed at the heel of the tab.

* * * * *